United States Patent [19]

Rachel

[11] 4,029,985

[45] June 14, 1977

[54] RECTANGULAR HEADLAMP FILAMENT SHIELD

[75] Inventor: Bernard W. Rachel, Lyndhurst, Ohio

[73] Assignee: General Electric Company, Schenectady, N.Y.

[22] Filed: Mar. 24, 1976

[21] Appl. No.: 669,985

[52] U.S. Cl. ..... 313/115; 240/41 SB; 240/41.25; 240/41.35 E; 313/117

[51] Int. Cl.[2] ..... F21V 7/14; H01K 1/26; H01K 1/30

[58] Field of Search ..... 313/117, 113, 114, 115; 240/41 SB, 41.25, 41.35 E

[56] References Cited

UNITED STATES PATENTS

| | | | |
|---|---|---|---|
| 2,869,011 | 1/1959 | Verbeek | 313/117 X |
| 3,317,772 | 5/1967 | Lindae | 313/113 |
| 3,553,520 | 1/1971 | Hicks | 313/113 |
| 3,898,451 | 8/1975 | Murphy et al. | 240/41 SB |
| 3,962,596 | 6/1976 | Draper | 313/117 |

*Primary Examiner*—Siegfried H. Grimm
*Attorney, Agent, or Firm*—Paul F. Wille; Lawrence R. Kempton; Frank L. Neuhauser

[57] ABSTRACT

A filament shield is disclosed which eliminates much of the lower beam glare caused by the rectangular shape of the headlamp.

9 Claims, 3 Drawing Figures

RECTANGULAR HEADLAMP FILAMENT SHIELD

BACKGROUND OF THE INVENTION

This invention relates to vehicle headlamps and, in particular, to rectangular vehicular headlamps adapted to produce one or more light beams, at least one of which is a depressed beam suitable for use when passing vehicles traveling in the opposite direction.

In the automotive industry, the size, shape, and placement of headlamps as well as the optical performance of headlamps are subject to regulation by an agency of the Federal Government. A recent change in these regulations has enabled the use of headlamps having a rectangular shape when viewed from the front.

The rectangular shape of the lens is enabled by cutting the paraboloidal reflector with planes (herein referred to as "sidewalls") to produce the desired shape at the open end of the paraboloid. When glass having the prescribed shape is aluminized (given a reflective coating, usually on the inner surface of the paraboloid), the sidewalls are also made reflective.

A finished lamp, having the reflector thus described, produces considerable glare in use, i.e., undesirable high levels of light. On the "low beam" setting, extraneous light has been found above the correct high intensity area of the beam pattern. Much of this light comes from the lower sidewall of the lamp. Light reflected from the upper sidewall, when further reflected by bumpers or other reflecting surfaces around the headlamp, adds to the glare, as does light from the left and right sidewalls. This glare makes it difficult to meet the government regulations noted above and makes the lamp inferior in adverse weather conditions where backscatter impedes visibility, e.g., rain, fog, and snow.

The problem has been recognized in the industry, and the solution to date has been to burn away some of the coating from the sidewalls of the lamp. Unfortunately, when the coating is removed from the sidewalls, it is also removed, to a lesser extent, from the paraboloidal surface. This reduces the effectiveness of the reflector and, hence, the maximum candle power of the lamp. In addition, the burning process is not uniform from lamp to lamp and is detrimental to lamp appearance.

In lower beam headlamps, round or rectangular, a filament shield is used over the lower beam filament to prevent light from the filament from going directly to the lens. In round lamps, control of the beam is thus assured by the reflector and the lens prescription. So far as is known, no one has proposed using a filament shield to prevent light from reaching portions of the reflector of a headlamp. For example, see U.S. Pat. Nos. 2,277,563; 2,366,292; 2,858,467; 2,880,347; 2,987,643; and 3,136,914, in which the filament shield does not cut off the filament light going to the reflector. In U.S. Pat. Nos. 2,795,722 and 3,908,144, it may appear that such is the case. However, what is actually provided are two sets of optics in a single structure to obtain a two-color light output, usually red and white.

SUMMARY OF THE INVENTION

In view of the foregoing, it is therefore an object of the present invention to provide an improved rectangular headlamp.

Another object of the present invention is to provide an all-weather rectangular headlamp.

A further object of the present invention is to provide an improved filament shield for a rectangular headlamp.

Another object of the present invention is to reduce the glare from a rectangular headlamp by blocking the filament light from selected portions of the reflector.

The foregoing objects are achieved in the present invention wherein the filament shield comprises a first surface having a cross section which is geometrically similar to the shape of the lens. Attached to the sides of the shield are tabs having shapes geometrically similar to the respective sidewall adjacent each tab and aligned with respect to a filament of the lamp to prevent light from the filament from impinging on the sidewalls.

DESCRIPTION OF THE PREFERRED EMBODIMENTS

Figure 1:
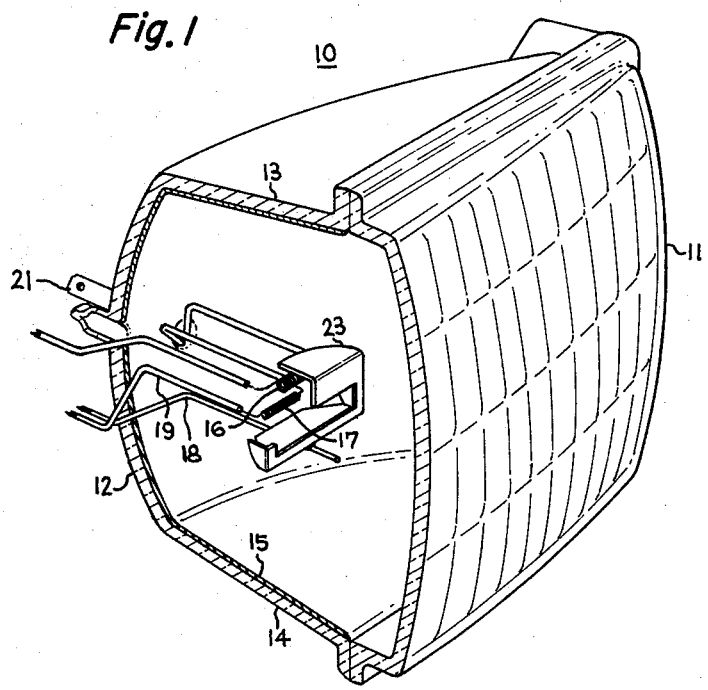
FIG. 1 illustrates a rectangular headlamp in accordance with the present invention.

In FIG. 1, lamp 10 comprises a cover glass or lens 11 sealed to a pressed glass reflector 12 about the periphery thereof. Reflector 12 is in the shape of a paraboloidal reflector intersected by planes forming top, bottom, left, and right sidewalls, of which top sidewall 13 and bottom sidewall 14 are illustrated in FIG. 1. The inner surface of reflector 12 is provided with a coating 15 of a suitable light-reflecting material such as aluminum or silver. As illustrated in FIG. 1, in accordance with the present invention, it is unnecessary to remove the reflective coating from the sidewalls.

Located in the region of the focus of the paraboloidal surface formed by reflector 12 are one or more filaments, such as filaments 16 and 17 which are connected by leads 18 and 19 to contacts 21 in the manner known in the art. As known in the art, one of filaments 16 and 17 is positioned at the focus of reflector 12 while the other filament is positioned slightly off focus to form an upper beam pattern. In the particular case illustrated, the invention is shown as embodied in a headlamp having two filaments with separate filaments for selectively producing either a lower beam for use when passing vehicles traveling in the opposite direction or an upper beam for use in open country. It should be understood however that the invention is applicable as well to single filament headlamps for producing only one light beam such as, for example, a lower beam.

In accordance with the present invention, headlamp 10 is provided with a light-intercepting shield 23 which is mounted in front of filaments 16 and 17 and is shaped to intercept not only the light which would directly impinge upon lens 11, but also the light that would impinge on certain portions of reflector 12, specifically the sidewalls. While shield 23 may be held in place by any suitable means, it is preferably supported in lamp 10 by being crimped or otherwise secured to a rigid support wire, which in turn is secured in the same manner as filament lead-in wires 18 and 19.

Figure 2:
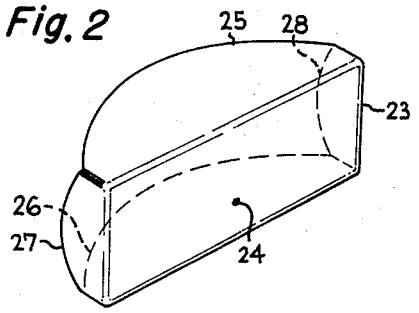
FIG. 2 is a perspective view of a filament shield in accordance with the present invention.

FIG. 2 illustrates in perspective the configuration of shield 23 which partially surrounds filaments 16 and 17. Specifically, shield 23 comprises a planar surface 24 having a shape that is geometrically similar to the cross section of lens 11. By geometrically similar is meant that the shadow cast by planar surface 24 is approximately the same shape as lens 11. Connected to surface 24 at the edges thereof are a plurality of tabs 25–28 which serve to shield the sidewalls and are geometrically similar to the sidewalls so that the light from neither filament can directly impinge upon the respective sidewall adjacent each tab.

Due to surface 24, lens 1 does not receive light directly from either filment 16 or filament 17. Tabs 25–28 prevent light from directly impinging upon any of the sidewalls. Thus, it is not necessary to burn off the reflective coating from any of the sidewalls of the lamp in accordance with the present invention. This increases the uniformity of coating obtainable in each lamp and, additionally, reduces the glare produced by the lamp in assuring that direct light impinges only upon the desired portions of reflector 12 so that the light emitted by lamp 10 is more carefully controlled.

Figure 3:
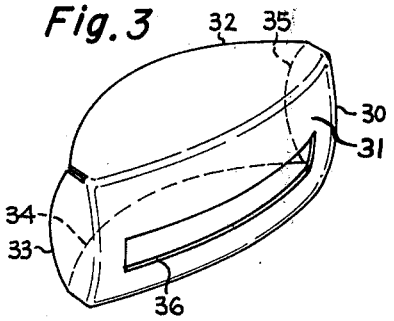
FIG. 3 is a perspective view of an alternative embodiment of a filament shield in accordance with the present invention.

FIG. 3 illustrates an alternative embodiment of the present invention in which shield 30 is provided with a nonplanar surface 31 for shielding lens 11 from direct light from the filaments. The shape of surface 31 is not critical provided that surface 31 terminates in a plane and the intersection of surface 31 and that plane define a shape geometrically similar to the shape of the lens 11. Similarly, tabs 32–35 need not be planar but may have any desired surface so long as the projection of the shapes of tabs 32–35 by filaments 16 and 17 corresponds to the shape of the respective sidewall adjacent each tab.

In addition, shield 30 may be provided with aperture 36 for enabling direct light from one of filaments 16 and 17 to impinge on lens 11, for example, when the lamp is used to produce an upper driving beam for use in open country. As is known by those of skill in the art, the shape of aperture 36 depends upon the beam pattern characteristics desired, as more fully described in the aforementioned U.S. Pat. No. 3,136,914.

There is thus provided by the present invention an improved light shield for rectangular headlamps which both reduces the glare from these headlamps and, at the same time, simplifies the manufacture thereof. As is apparent to those of skill in the art, various modifications can be made within the spirit and scope of the present invention. For example, it is within the contemplation of the present invention to use a non-lit filament as part of the shield in a multifilament lamp. Specifically, in a two-filament lamp, part of tab 34 was removed since it was preventing light from upper beam coil 17 from reaching the paraboloidal surface. However, when coil 16 is incandescent, coil 17 shields lower sidewall 14 in addition to tab 34.

What I claim as new and desire to secure by Letters Patent of the United States is:

1. In a rectangular headlamp having a lens, a reflector in the shape of paraboloid intersected by four planes which form the sidewalls thereof, and at least one filament positioned in the region of the focus of said paraboloid, the improvement comprising:

filament shield means having a first portion positioned between said filament and said lens and a second portion comprising a plurality of tabs positioned between said filament and respective sidewalls, wherein said first portion is geometrically similar to said lens and said tabs are geometrically similar to the respective sidewalls.

2. The headlamp as set forth in claim 1 wherein said first portion is planar.

3. The headlamp as set forth in claim 1 wherein said first portion is three dimensional.

4. The rectangular headlamp as set forth in claim 1 wherein said tabs are attached to the periphery of said first portion.

5. The headlamp as set forth in claim 4 wherein said shield is completely opaque.

6. The rectangular headlamp as set forth in claim 4 wherein said first portion contains an aperture for selectively permitting light from said filament to reach said lens directly.

7. The rectangular headlamp as set forth in claim 6 wherein said lamp comprises two filaments, one of which intersects the focus of said paraboloid.

8. The rectangular headlamp as set forth in claim 7 wherein said filament shield means includes the non-incandescent one of said filaments.

9. The rectangular headlamp as set forth in claim 8 wherein said filament shield means includes the other of said filaments.

* * * * *